United States Patent [19]

Speraggi

[11] 4,410,291

[45] Oct. 18, 1983

[54] ANTINOISE DEVICE FOR IMPACT SERIAL PRINTERS

[75] Inventor: Marcello Speraggi, Milan, Italy

[73] Assignee: Honeywell Information Systems Italia, Caluso, Italy

[21] Appl. No.: 350,461

[22] Filed: Feb. 19, 1982

[30] Foreign Application Priority Data

Feb. 24, 1981 [IT] Italy ..... 19935 A/81

[51] Int. Cl.[3] ..... B41J 29/10

[52] U.S. Cl. ..... 400/689; 400/247

[58] Field of Search ..... 400/689, 713, 714, 124, 400/538, 540, 535, 521, 247

[56] References Cited

U.S. PATENT DOCUMENTS 3,887,055 6/1975 Pastrick ..... 400/538 X
4,061,219 12/1977 Nishikawa et al. ..... 400/124
4,165,188 8/1979 Rempel ..... 400/124

FOREIGN PATENT DOCUMENTS 55-133982 10/1980 Japan ..... 400/124

OTHER PUBLICATIONS

IBM Technical Disclosure Bulletin, vol. 15, No. 11, Apr. 1973, pp. 3398-3399, Article by Boyatt, Jr., "Peripheral Print Shield".

*Primary Examiner*—Edgar S. Burr
*Assistant Examiner*—Charles A. Pearson
*Attorney, Agent, or Firm*—Nicholas Prasinos

[57] ABSTRACT

A serial printer is disclosed where the printing is performed by a printing head (22) mounted on a carriage (21) movable along the printing line, a transparent leaf (36) mounted on the carriage presses the printing support (25) (paper) against a platen (24) around the zone where the impression is performed thus considerably reducing the noise and vibration generated by the printing support vibrations during the printing.

Preferably, the leaf is provided with a window (45) wherein the impression is performed in order to press the printing support against the platen all around the print zone. As the leaf is transparent, it does not preclude the visibility of what is printed. Besides, as the leaf is mounted on the carriage, when the carriage is in its travel position, the leaf does not interfere with the loading of the printing support in the printer.

2 Claims, 4 Drawing Figures

ANTINOISE DEVICE FOR IMPACT SERIAL PRINTERS

BACKGROUND OF THE INVENTION

1. Field of the Invention

The present invention relates to an antinoise device for impact serial printers used in data processing systems.

2. Description of the Prior Art

It is known that one of the main inconveniences of the impact printers is the considerable noise generated during their working. This is one of the reasons which have led the manufacturers to invest in the research and development of non-impact printers which are intrinsically noiseless (e.g. ink jet, electrostatic and so on). However, the need to have several printed copies existing in several administrative activities still requires the use of impact printers; moreover, the printing speed of impact printers of matrix type satisfies, at present, the need of a large range of users.

In the prior art, the solutions adopted to reduce the noise of such printers were to equip them with covers and frames internally lined with deadening material and enclosing the noise source in the best possible way. The purpose, however, was to reduce the effects not to remedy the causes, since the noise causes were considered impossible to be eliminated or reduced.

It is known that an impact serial printer generally comprises a rigid frame equipped with parallel guides arranged in the direction of the printing line and a platen on which a printing support is leaned. Guides and platen are strictly fixed to the frame and are part of the same. A printing carriage equipped with a printing head, (such as a needle head), which slides on guides for mosaic printing or font bearing element for solid font printing.

It has been experimentally noted that the main noise source is given by the impact of the platen caused by the printing head and by the vibrations of the printing support (paper), which acts as a vibrating membrane caused by the printing operations. What is required is to eliminate the causes of the noise rather than the effects.

OBJECTS OF THE INVENTION

It is an object of the invention therefore to provide an improved impact printer.

It is another object of the invention to provide an improved impact printer by reducing noise.

Still another object of the invention is to provide an antinoise device for impact serial printers.

SUMMARY OF THE INVENTION

According to the invention, a noise reduction is obtained by means of an elastic element, frame shaped which presses the printing support against the platen, close to the zone where the impression is performed. Such an elastic element is mounted on the printing carriage and operates in a zone of the printing line variable according to the carriage position. When the carriage is placed at the beginning or at the end of the printing line, the elastic element does not interfere with the printing support, and therefore it permits easy loading of the printer with the printing support. Besides, such elastic element is conveniently produced with transparent material in order to allow the reading of the printing line. These and other features of the invention will appear more clearly from the description of a preferred embodiment of the invention and from the attached drawings where:

DETAILED DESCRIPTION OF THE PREFERRED EMBODIMENTS

Figure 1:
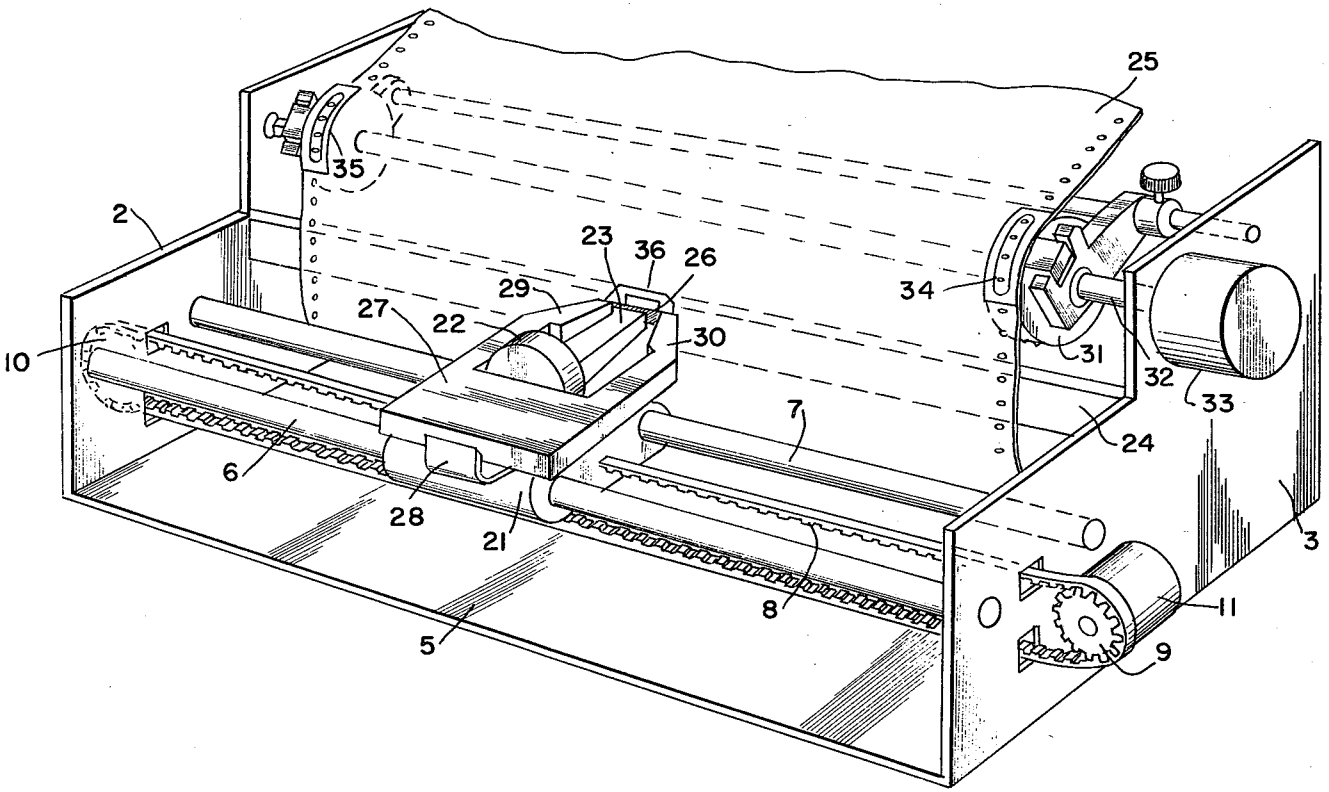
FIG. 1 is a perspective view of the mechanical structure of a printer including the antinoise device according to the invention.

With reference to FIG. 1, the mechanical structure of a printer comprises a mechanical frame constituted by a base 5 and two sides 2 and 3. Both base 5 and sides 2 and 3 are made with suitable thickness metal plate in order to have good stiffness of the equipment. In the alternative, cast structures can be used. A printing carriage 21 is slidably mounted on guiding bars 6 and 7 by means of bushings or axial bearing. A belt fixed to carriage 21 extends parallel to guide bars 6 and 7 and is wound to a driving pulley 9 on a side. On the other side, it is wound to an idle pulley 10 which is fixed to side 2 by means of a suitable U-bolt. Pulley 9 is splined to the shaft of motor 11, fixed to side 3. Motor 11, preferably a step motor, permits control through belt 8 of the movement of carriage 21 along the guide bars. A printing head 22, provided with a printing nose 23 is mounted on carriage 21; such nose, owing to the carriage movement, slides along the printing line near a platen 24. Platen 24 is comprised of a bar parallel to guide bars 6 and 7 fixed to sides 2 and 3. In the alternative, platen 24 may comprise of a rotating cylinder pivoted on sides 2 and 3.

Printing head 22 is of the needle type. The printing needles, not in sight, protrude from nose 23 pressing an inked ribbon 26 against printing support 25 which is leaned against platen 24. The inked ribbon is contained in cartridge 27, of the type described in British Pat. No. 1,502,760, published on Mar. 1, 1978. The cartridge is mounted on the printing carriage and is kept in position by means of elastic brackets 28. The cartridge is provided with two arms 29 and 30 which embrace printing head 22 and guide the inked ribbon up to the end of nose 23. Inked ribbon 26 is stretched between the two arms in front of nose 23. It is pulled out from arm 29 and pulled into arm 30 and into the cartridge by means of feeding means, not shown.

The printing support, generally of the type with side perforations, slides trasversely to the printing line, due to the driving action of two pin-wheels, one of which is shown in FIG. 1 and having reference numeral 31. The pin-wheels are engaged on a driving prismatic bar 32, pivoted on bushes mounted in sides 2 and 3 and arranged parallel to the guiding bars. The driving bar is actuated in intermittent rotation by a motor 33. The pin-wheels are provided with pressure pads 34 and 35 which assure the engagement of the printing support side perforations with the pins. They are slidably mounted on bar 32 to match their distance with the width of printing support being used.

Figure 3:
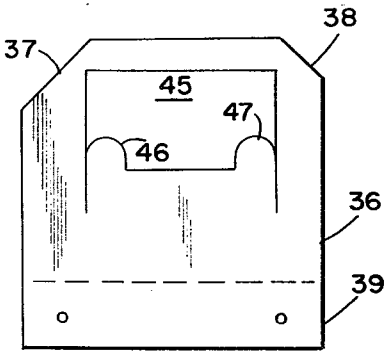
FIG. 3 is a front view of the antinoise device object of the invention.
Figure 2:
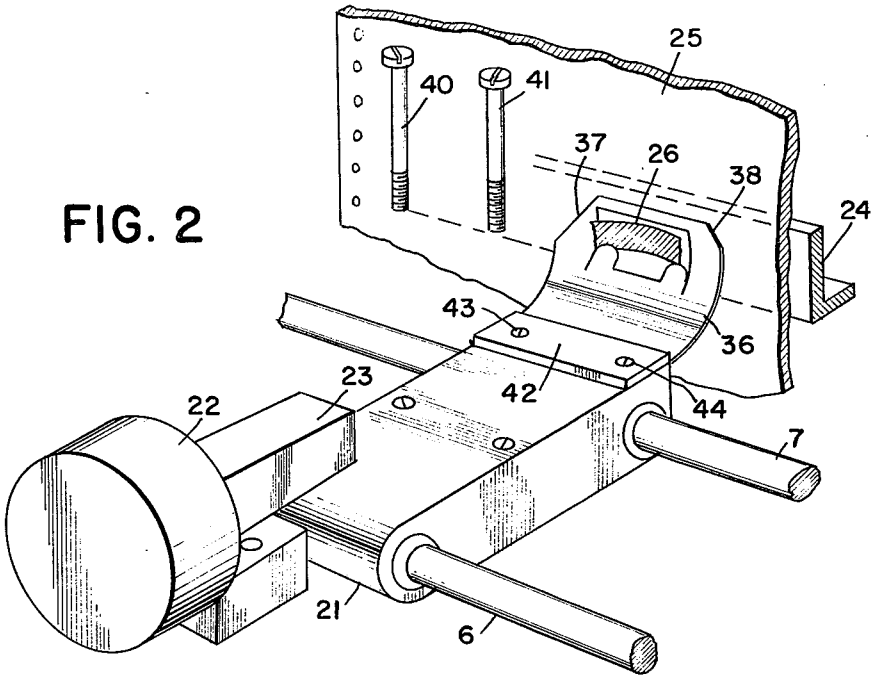
FIG. 2 is an exploded perspective view of the printing carriage of the printer in FIG. 1 and of the antinoise device object of the invention.

According to the invention a transparent elastic leaf 36 partially in sight on FIG. 1 is fixed to printing carriage 21 and leans on the printing support near ribbon 23 pressing it against platen 24. FIGS. 2 and 3 show in detail in perspective view and in top view the shape and the position of such leaf.

In FIG. 2 printing carriage 21 mounted on guides 6 and 7 is in sight. Printing head 22 is fixed on the printing carriage by means of screws 40 and 41. Elastic leaf 36 is fixed to the printing carriage too. Such leaf, substantially of rectangular shape with bevelled corners 37 and 38, is fixed to the printing carriage at its lower band 39 which is kept against the carriage by means of a rigid plate 42 fixed to the carriage by means of two screws 43 and 44. The position of plate 42 on the carriage is substantially horizontal while the platen is substantially vertical. Leaf 36 elastically bends thus leaning and pressing printing support 25 against platen 24.

The leaf is preferably made in transparent "MYLAR ®" and has a thickness in the order of tenth of millimeter. The use of MYLAR is not essential but is to be preferred to the use of other plastic films owing to its mechanical strength and its transparency.

Leaf 36 is provided with a substantially rectangular opening 45 within which two appendices 46 and 47 protrude which are obtained from the same leaf and arranged at the sides of rectangular opening 45. Leaf 45 is arranged (FIG. 2) on the printing support such that nose 23 of the printing head is practically placed in the center of opening 45. So, the higher edge of the leaf and appendices 46 and 47 press the printing support 25 against platen 24 very close to the support zone where impression is performed, preventing any vibrations of the support and the consequent noise. On the other hand, the elastic leaf does not interfere with the printing operation thanks to opening 45 and with the action of inked ribbon 26, which may get in contact with the printing support in alignment to opening 45 even if leaf 36 is placed in front of the printing support.

Figure 4:
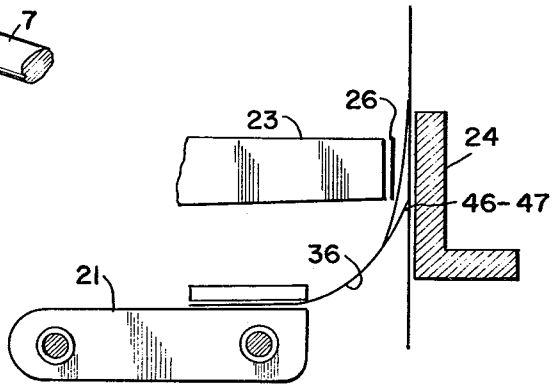
FIG. 4 is a side view of the antinoise device object of the invention as well as of part of the printing carriage and of the platen.

FIG. 4 shows in side view the bending of leaf 36 due to its restraint of carriage 21 and its relation to the position of platen 24. From such figure it can be clearly seen that leaf 36 leans against the printing support with its upper edge and with appendices 46 and 47 ends.

The reason for bevelling corners 37 and 38 and in particular the bevelled rounded shape of appendices 46 and 47 clearly appears from such figure. Because of such bevels, the contact of the leaf with the printing support is not abrupt so as to cause risk of clogging or tearing of the support during the carriage, and consequent leaf movement along the support; rather, an urging action is provided. Such bevels allow leaf 36 to gently overlap the printing support in correspondence with the perforated sides of the printing support when the printing carriage moves from the external positions towards the centre of the printing line. Such overlapping occurs without causing printing support tears and possible foldings of the support are also levelled by the bevels of flexible leaf 36.

It is clear that the previous description only relates to a preferred embodiment of the invention and that several changes can be made to the described embodiment without departing from the scope of the invention. However, described with reference to the use with a needle printing head, an antinoise elastic device of the described type can be used with the required changes in size and shape on serial printers with other kinds of printing heads for instance those where a font bearing element is used.

What is claimed is:

1. An antinoise device for serial printers of the type having a printing head mounted on a printing carriage sliding along a printing line and wherein the printing is made by the action of such printing head against a platen, a printing support being interposed between printing head and platen, such antinoise device comprising:

(a) a transparent elastic leaf provided with an opening through which said printing head performs an impression, said leaf further having a substantially rectangular shape with the two upper angles beveled, said leaf further being provided with two appendices which extend inside said opening, said leaf being fixed to said printing carriage and elastically bending against said platen near the zone where said printing head impacts the printing support, whereby said printing support is locally pressed against said platen by said leaf and its vibration is prevented.

2. An antinoise device as recited in claim 1 wherein said appendices inside the opening in said leaf is provided with a rounded end.

* * * * *